US005269226A

United States Patent [19]

Theurer et al.

[11] Patent Number: 5,269,226

[45] Date of Patent: Dec. 14, 1993

[54] BALLAST TAMPING ASSEMBLY WITH MECHANICAL STOPS ON TAMPING PICKS FOR LIMITING PIVOTAL MOVEMENT

[75] Inventors: Josef Theurer, Vienna; Friedrich Peitl; Wilhelm Praschl, both of Linz, all of Austria

[73] Assignee: Franz Plasser Bahnbaumaschinen-Industriegesellschaft m.b.H., Vienna, Austria

[21] Appl. No.: 963,832

[22] Filed: Oct. 20, 1992

[30] Foreign Application Priority Data

Oct. 24, 1991 [AT] Austria ..... A 2125/91

[51] Int. Cl.[5] ..... E01B 27/16

[52] U.S. Cl. ..... 104/12

[58] Field of Search ..... 104/10, 12

[56] References Cited

U.S. PATENT DOCUMENTS

| | | | |
|---|---|---|---|
| 3,534,687 | 10/1970 | Plasser et al. | 104/12 |
| 4,094,251 | 6/1978 | Theurer | 104/12 |
| 4,537,135 | 8/1985 | Theurer et al. | 104/12 |
| 5,007,349 | 4/1991 | Theurer | 104/12 |
| 5,127,334 | 7/1992 | Theurer | 104/12 |

FOREIGN PATENT DOCUMENTS

| | | |
|---|---|---|
| 378386 | 7/1985 | Austria . |
| 382179 | 1/1987 | Austria . |
| 424322 | 4/1991 | European Pat. Off. . |
| 2111107 | 6/1983 | United Kingdom . |
| 2201178 | 8/1988 | United Kingdom . |

*Primary Examiner*—Robert J. Oberleitner
*Assistant Examiner*—S. Joseph Morano
*Attorney, Agent, or Firm*—Collard & Roe

[57] ABSTRACT

An ballast tamping assembly comprises four independently displaceable ballast tamping units arrayed in a line extending transversely to the machine frame elongation. Each ballast tamping unit comprises a carrier frame, a tamping tool carrier vertically adjustably mounted on the carrier frame, and a pair of vibratory tamping tools mounted on the tamping tool carrier for reciprocation in the track direction. Each vibratory tamping tool has a tamping pick remote from the carrier frame and pivotal about an axis extending in the direction of the machine frame elongation and connected to a pivoting drive, and another tamping pick immediately adjacent the carrier frame and fixedly connected to the tamping tool, the remote tamping pick being pivotal between two end positions delimited by respective stops, a first one of the end positions being immediately adjacent the other tamping pick for immersion of the tamping picks at one rail side and the second end position being remote from the other tamping pick for immersion of the tamping picks at respective rail sides. Independently operable drives are connected to the ballast tamping units for displacing the ballast tamping units in a direction extending transversely to the machine frame elongation.

8 Claims, 2 Drawing Sheets

29
31
1
2
2
8
10
7
3
9
9
18
18
5
15
12
6
13
13
4

1
29
2
2
31
30
28
8
10
11
9
3
7
8
10
11
9
3
18
18
12
15
15
13
13
25
24
5
6
7
5
19
14
14
16
17
20
22
22
26
21
23
α
β
4
4
27
27
27
II

BALLAST TAMPING ASSEMBLY WITH MECHANICAL STOPS ON TAMPING PICKS FOR LIMITING PIVOTAL MOVEMENT

BACKGROUND OF THE INVENTION

1. Field of the Invention

The present invention relates to an assembly for tamping ballast supporting a track having rails, each rail having a gage side and a field side, the ballast tamping assembly being mounted on a machine frame of a track tamper and the machine frame being elongated in the direction of the track, the ballast tamping assembly comprising four independently displaceable ballast tamping units arrayed in a line extending transversely to the machine frame elongation, each ballast tamping unit comprising a carrier frame, a tamping tool carrier vertically adjustably mounted on the carrier frame, and a pair of vibratory tamping tools mounted on the tamping tool carrier for reciprocation in the track direction, each vibratory tamping tool having a tamping pick pivotal about an axis extending in the direction of the machine frame elongation and connected to a pivoting drive. Independently operable drives are connected to the ballast tamping units for displacing the ballast tamping units in a direction extending transversely to the machine frame elongation.

2. Description of the Prior Art

Such a ballast tamping assembly has been disclosed in U.S. Pat. No. 5,007,349, the four transversely independently displaceable ballast tamping units being mounted on a carrier which is rotatably mounted on the machine frame of a track tamper. Each ballast tamping unit has a pair of reciprocal vibratory tamping tools, and each tamping tool has two transversely adjacent tamping picks for immersion in the ballast alongside one of the rail sides. This arrangement makes the tamping pick positions more adaptable to the irregular track rail positions in track switches. In one embodiment of this ballast tamping assembly, all the tamping picks are transversely pivotal about axes extending in the direction of the machine frame elongation, and each tamping pick is connected to a pivoting drive. While this adds to the adaptability of the tamping pick positions to changing track rail positions, a proper positioning of the 16 pivotal tamping picks of the four ballast tamping units requires a disadvantageously long time and concentration by the operator during each tamping cycle.

Austrian patent No. 382,179 discloses a ballast tamping assembly with two independent ballast tamping units with one carrier frame and two tamping tool carriers independently vertically adjustably mounted thereon. Each tamping tool carrier has a pair of vibratory and reciprocatory tamping tools for immersion along the field side and the gage side of an associated rail, respectively. Each tamping tool has a tamping pick pivotal about an axis extending in the direction of the machine elongation. This enables any tamping pick to be pivoted out of the way of any obstacle encountered during tamping so that the tamping tools may be suitably immersed in the ballast even when such an obstacle is encountered. Such pivotal tamping picks are also disclosed in U.S. Pat. Nos. 3,534,687 and 4,537,135, and all these ballast tamping arrangements have the disadvantage that the distance between the four tamping units mounted on a common carrier frame is not variable for use under varying operating conditions.

British patent No. 2,201,178 discloses a ballast tamping assembly with four transversely independently displaceable ballast tamping units, the tamping picks of the tamping tools of each tamping unit being fixedly connected to the tamping tools. This prevents considerable portions of a track switch from being tamped, as is quite clear from FIG. 4 of the patent.

Austrian patent No. 378,386 discloses a ballast tamping assembly with two ballast tamping units whose carrier frame for a pair of reciprocable tamping tools is pivotal about an axis extending in the direction of the machine frame elongation so that the tamping tools may be consecutively immersed at the respective rail sides. Each tamping tool has two tamping picks one of which is pivotal about an axis extending in the direction of the machine frame elongation. This enables the pivotal tamping pick to be pivoted from a normal tamping position slightly spaced from the other tamping pick to another position wherein the tamping picks overlap. This reduces the effective immersion width of the tamping picks and enables the tamping unit to operate in relatively narrow tamping spaces, such as the point where a branch track branches off the main track. However, as FIG. 2 of the patent shows, at this point the ballast tamping unit must be consecutively centered, lowered and raised at each side of the rail for tamping.

SUMMARY OF THE INVENTION

It is the primary object of this invention to improve a ballast tamping assembly of the first-described type by simplifying the positioning of the tamping picks without substantially increasing the structural complexity of the arrangement so that the ballast tamping assembly is capable of effective tamping in the largest possible areas of track switches.

The above and other objects are accomplished according to the invention with such a ballast tamping assembly wherein each vibratory tamping tool has a tamping pick remote from the carrier frame and pivotal about an axis extending in the direction of the machine frame elongation and connected to a pivoting drive, and another tamping pick immediately adjacent the carrier frame and fixedly connected to the tamping tool, the remote tamping pick being pivotal between two end positions delimited by respective stops, a first one of the end positions being immediately adjacent the other tamping pick for immersion of the tamping picks at one rail side and the second end position being remote from the other tamping pick for immersion of the tamping picks at respective rail sides.

This arrangement makes it possible for the first time to center the tamping tools over all the intersections of the rails and ties, where the ballast supports the track, to make a complete tamping of a track switch possible. It is a particular advantage of this arrangement that the pivoting of the pivotal tamping picks is limited to two end positions so that the control for the correct positioning of the pivotal tamping picks is reduced to a minimum. This greatly facilitates the tamping operation because it limits the concentration of the operator required for this operation substantially. It is no longer necessary for the operator to control the infinite number of pivotal tamping pick positions of up to 16 picks, as in the known arrangements, but the operator needs to decide only between two end positions; and even this decision is required only at those track points where a very small angle between the main track and a branch track leaves such a narrow space between the track rails that two tamping picks cannot be immersed in the ballast side-by-side.

It is another substantial advantage of the present ballast tamping assembly that the ballast at the field side and the gage side of a rail positioned between the two tamping picks in the second end position of the pivotal tamping pick may be tamped simultaneously, with a single centering of the ballast tamping unit over the rail and a single immersion of the tamping picks in the ballast. This simplification of the tamping operation considerably increases the speed and efficiency of the switch tamping, particularly since track switches have many obstacles to tamping, such as frogs, auxiliary rails, switch blades and the like, all of which require a different positioning of the ballast tamping units and/or their tamping picks almost during every tamping cycle.

Preferably, a longitudinal axis of the other tamping pick is inclined towards the carrier frame, with a lower end thereof being closer to the carrier frame than an upper end thereof, and a longitudinal axis of the pivotal tamping pick extends substantially parallel to the other tamping pick in the first end position thereof, in which case the angle between the longitudinal axis of the other tamping pick and a vertical plane is between about 5° and 10°, preferably 7°, and the angle between the longitudinal axis of the pivotal tamping pick and a vertical plane is between about 5° and 10° in the second end position, preferably 7°. This enables two immediately adjacent tamping tool units whose tamping tool carriers have their pairs of tamping tools arranged laterally to tamp the ballast at each side of a rail without problems. Furthermore, the pivotal tamping pick will not be too steeply inclined when pivoted into the second end position so that the two transversely spaced apart tamping jaws of the picks will be at the same level with respect to the lower edge of the adjacent track tie when immersed in the ballast for tamping.

To obtain a particularly stable and structurally simple arrangement of the stops while using a very short pivoting drive, the ballast tamping arrangement preferably further comprises a bearing for the pivoting axis of the remote tamping pick, the stops delimiting pivoting of the remote tamping pick being arranged adjacent the bearing on the pivotal and other tamping picks, the pivoting drive for the pivotal tamping pick being linked to the pivotal tamping pick at a side thereof opposite the stops in a direction extending transversely to the machine frame elongation.

BRIEF DESCRIPTION OF THE DRAWING

The above and other objects, advantages and features of the invention will become more apparent from the following detailed description of a now preferred embodiment thereof, taken in conjunction with the accompanying, somewhat schematic drawing wherein.

DETAILED DESCRIPTION OF THE PREFERRED EMBODIMENT

Figure 2:
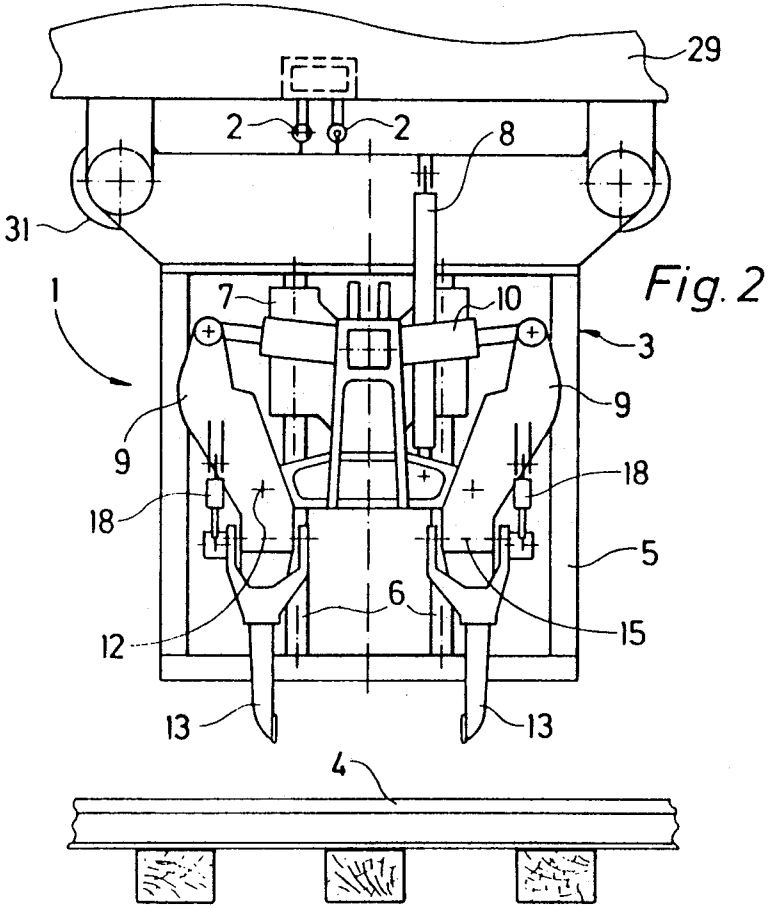
FIG. 2 is a side elevational view of one of the identical ballast tamping units, seen in the direction of arrow II of FIG. 1.
Figure 1:
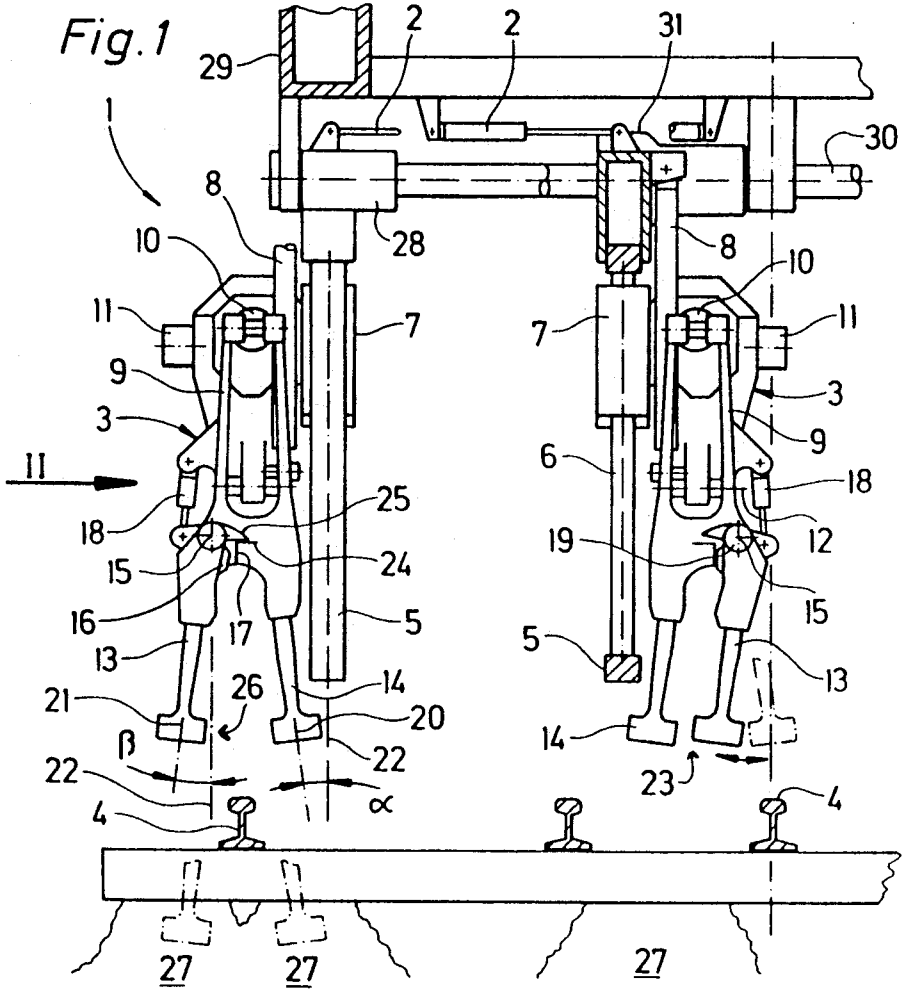
FIG. 1 is a fragmentary end view, partly in section, showing only two of the four ballast tamping units operable at the field sides of the track rails of a main track, the two other ballast tamping units at the gage sides of the track rails being identical therewith and not being shown to simplify the view.

FIGS. 1 and 2 illustrate assembly 1 for tamping ballast supporting a track having rails 4, each rail having a gage side and a field side. The ballast tamping assembly is mounted on machine frame 29 of a track tamper and the machine frame is elongated in the direction of the track. The ballast tamping assembly comprises four independently displaceable ballast tamping units 3 (only two of the four identical units being shown in FIG. 1) arrayed in a line extending transversely to the machine frame elongation. Each ballast tamping unit comprises carrier frame 5, tamping tool carrier 7 vertically adjustably mounted on the carrier frame by means of vertical guide posts 6. Tamping tool carrier 7 is vertically adjustable on carrier frame 5 by means of drive 8. A pair of vibratory tamping tools 9 are mounted on tamping tool carrier 7 at an outer side thereof with respect to carrier frame 5 for reciprocation in the track direction. Tamping tools 9 are spaced from each other in the direction of the machine frame elongation and are connected to reciprocating drive 10 for reciprocation and to vibrating drive 11 for vibration about horizontal axis 12 extending perpendicularly to the machine frame elongation.

Each carrier frame 5 has a guide bushing 28 at an upper end thereof, which is transversely displaceably guided along transverse guide 30 affixed to machine frame 29 of a track tamper. Independently operable drives 2 connect guide bushings 28 to machine frame 29 for transversely displacing ballast tamping units in a direction extending transversely to the machine frame elongation. All of the above-described structure is entirely conventional.

According to the present invention, each vibratory tamping tool 9 has a tamping pick 13 remote from carrier frame 5 and pivotal on the tamping tool about axis 15 extending in the direction of the machine frame elongation. Tamping pick 13 is connected to tamping tool 9 by pivoting drive 18. Another tamping pick 14 immediately adjacent carrier frame 5 is fixedly connected to tamping tool 9. The remote tamping pick 13 is pivotal between two end positions delimited by respective stops 16, 17, 24, 25. As shown in the drawing, the stops delimiting pivoting of the remote tamping pick 13 are arranged adjacent bearing 19 for pivoting axis 15 of the remote tamping pick. Stops 16 and 25 are arranged on the pivotal tamping pick, and stops 17 and 24 are arranged on the other tamping pick. Pivoting drive 18 for the pivotal tamping pick is linked to the pivotal tamping pick at a side thereof opposite the stops in a direction extending transversely to the machine frame elongation.

The first end position of pivotal tamping pick 13 immediately adjacent the other tamping pick 14 for immersion of the tamping picks at one rail side is shown at the right side of FIG. 1 and the second end position remote from the other tamping pick for immersion of the tamping picks at respective rail sides is shown at the left side of FIG. 1. Guide bushings 28 of the two centrally arranged ballast tamping units have radial extensions 31 which can engage any part of carrier frame 5 of the outer ballast tamping units 3 projecting towards the center from guide bushing 28. This enables the two ballast tamping units at each half of the machine frame to be readily transversely displaced into an immediately adjacent position (see FIGS. 4 to 6) so that ballast areas 27 at the field and gage sides of a rail 4 may each be tamped by the two tamping picks 13, 14.

As shown in FIG. 1, longitudinal axis 20 of the other tamping pick 14 is inclined towards carrier frame 5, with a lower end thereof being closer to the carrier frame than an upper end thereof, and longitudinal axis 21 of pivotal tamping pick 13 extends substantially parallel to the other tamping pick 14 in the first end position 23 thereof (shown on the right in FIG. 1 in full lines). The angle between longitudinal axis 20 and a vertical plane 22 is between about 5° and 10°, the preferred angle $\alpha$ of 7° being illustrated. Likewise, the angle between longitudinal axis 21 of pivotal tamping pick 13 and vertical plane 22 is between about 5° and 10° in the second end position, the preferred angle $\beta$ of 7° being shown.

Pivoting drive 18 enables remote tamping pick 13 to be pivoted between first end position 23 delimited by stops 16, 17 and second end position 26 delimited by stops 24, 25. In first end position 23, tamping picks 13 and 14 form a pair of tamping picks arranged to tamp ballast 27 at one side of a rail 4 to which ballast tamping unit 3 has been moved by its drive 2, as shown in FIG. 1. In second end position 26, shown at the left side of FIG. 1, the two tamping picks are sufficiently spread apart to immerse one of the tamping picks at the field side and the other tamping pick at the gage side of associated rail 4 for tamping ballast 27 at both sides of the rail, as indicated by phantom lines.

Figure 3:
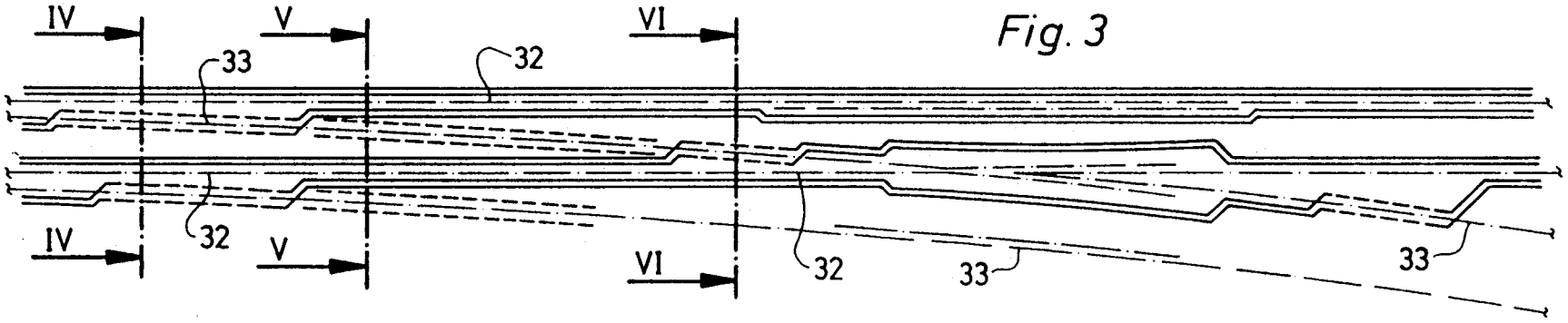
FIG. 3 is a schematic top view of a track switch, the areas tamped by the ballast tamping units being shown in full and broken lines.

In the track switch shown in FIG. 3, rails 32 of the main track and rails 33 of the branch track are shown in phantom lines. The areas of the ballast supporting the track rails, which can be tamped in first end position 23, are shown in full lines while those ballast areas which can be tamped in second end position 26 of the tamping picks are shown in broken lines. As clearly illustrated, ballast tamping arrangement 1 is capable of tamping almost the entire switch with the tamping picks in their respective end positions, even in the most difficult switch areas where many obstacles are encountered to the immersion of the tamping picks into the ballast. The portion of the outer rail 33 of the branch track, which cannot be tamped with ballast tamping assembly 1, can be readily tamped at the time the branch track is tamped.

Figure 6:
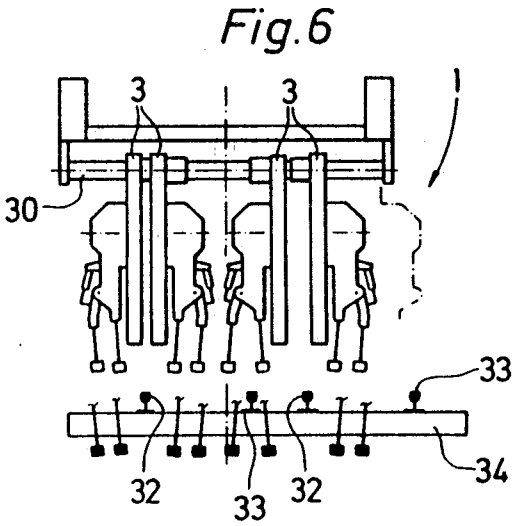
FIGS. 4 to 6 are diagrammatic end views showing the tamping picks of the ballast tamping assembly in different operating positions.
Figure 5:
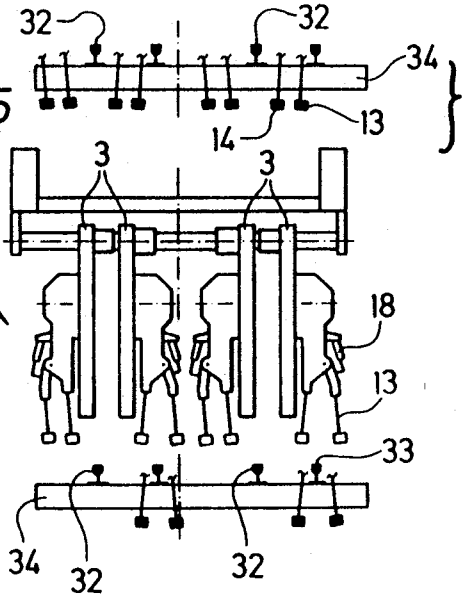
Figure 4:
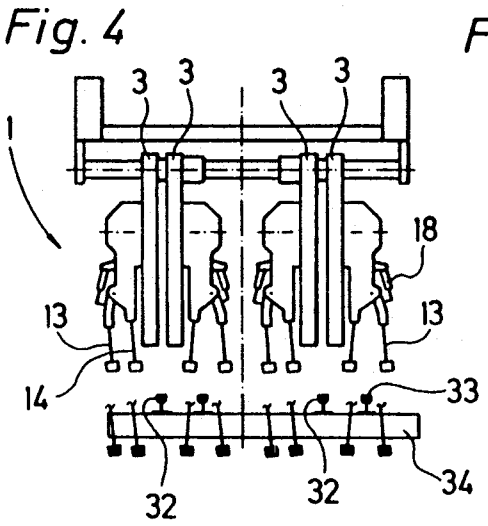

FIGS. 4, 5 and 6 show the transverse displacement positions of the four ballast tamping units 3 and the pivotal positions of tamping picks 13 determining the relative position of tamping picks 13, 14 relative to each other at track points IV—IV, V—V and VI—VI of FIG. 3, respectively.

In position IV-IV shown in FIG. 4, drives 2 are operated to center two ballast tamping units over one rail 32 of the main track and two ballast tamping units are centered over the other rail 32 of the main track. Looking at the figure from left to right, tamping picks 13, 14 of the first and third ballast tamping units 3 at the field side of one rail and the gage side of the other rail are positioned parallel to each other in end position 23 while pivoting drives 18 are operated to pivot tamping picks 13 of the second and fourth ballast tamping units into second end position 26 in which the tamping picks 13, 14 straddle rails 33 of the branch track. In this position, vertical adjustment drives 8 of all four ballast tamping units 3 may be operated at the same time to immerse all of the tamping picks in the ballast to tamp ballast under tie 34 simultaneously at six points 27 adjacent each other transversely to the main and branch tracks, i.e. two tamping picks will tamp the ballast at the field side of one main track rail and the gage side of the other main track rail while one tamping pick will tamp the ballast on the gage side of one branch track rail and the field side of the other branch track rail, and one tamping pick will tamp the ballast on the field side of the one branch track rail (which is close to the gage side of the one main track rail) and on the gage side of the other branch track rail (which is close to the field side of the other main track rail).

As ballast tamping assembly 1 moves farther into the track switch to position V—V, a first tamping cycle is initiated, as shown at the top of FIG. 5, in which the four ballast tamping units 3 are centered by drives 2 respectively at the field and gage sides of main track rails 32 while tamping picks 13 are pivoted into first end position 23 so that tamping picks 13, 14 extend parallel to each other. In this position, ballast is tamped under tie 34 at the field and gage sides of rails 32 by two tamping picks. After the first tamping cycle has been completed, ballast tamping units 3 are raised (see the lower part of FIG. 5) and the second and fourth ballast tamping units (from left to right) are transversely displaced by drives 2 until their tamping picks straddle branch track rails 33 in second end position 26 of the tamping picks, obtained by operating pivoting drives 18 to pivot tamping picks 13 into the second end position. These ballast tamping units are then lowered into the ballast by drives 8 to tamp the ballast under the tie at both sides of the branch track rails by the tamping picks 13 and 14.

Farther into the track switch, at position VI—VI (FIG. 6), as seen from left to right, first and second ballast tamping units 3 are transversely displaced to be centered over one main track rail 32 so that the pairs of tamping picks in their first end position 23 may be immersed in the ballast at the field and gage sides of the one rail, respectively. This is the tamping pick position assumed normally in all track sections where no obstacles to the immersion of the tamping tools into the ballast are encountered. The third ballast tamping unit is transversely displaced by its drive 2 until the tamping picks thereof straddle one branch track rail 33 in second end position 26 of the tamping picks, obtained by operating pivoting drive 18 to pivot tamping pick 13 into the second end position. The fourth ballast tamping unit is transversely displaced by its drive 2 until the tamping picks thereof in first end position 23 may be immersed at the field side of the other main track rail 32. After this tamping cycle, fourth ballast tamping unit 3 may be further transversely displaced towards the other branch track rail 33 (see phantom lines) so that the gage side of the other branch track rail may be tamped. The field side of the other branch track rail cannot be tamped with ballast tamping assembly 1 from point VI—VI on, as the branch track deviates further from the main track, and this tamping must be effected when the branch track is tamped.

What we claimed is:

1. An assembly for tampering ballast supporting a track having rails, each rail having a gage side and a field side, the ballast tamping assembly being mounted on a machine frame of a track tamper and the machine frame being elongated in the direction of the track, the ballast tamping assembly comprising (a) four independently displaceable ballast tamping units arrayed in a line extending transversely to the machine frame elongation, each ballast tamping unit comprising (1) a carrier frame, (2) a tamping tool carrier vertically adjustably mounted on the carrier frame;

(3) a pair of vibratory tamping tools mounted on the tamping tool carrier for reciprocation in the track direction, each vibratory tamping tool having a tamping pick remote from the carrier frame and pivotal about an axis extending in the direction of the machine frame elongation and connected to a pivoting drive, and another tamping pick immediately adjacent the carrier frame and fixedly connected to the tamping tool, the remote tamping pick being pivotal between a first end position immediately adjacent the other tamping pick for immersion of the tamping picks at one rail side and a second end position remote from the other tamping pick for immersion of the tamping picks at respective ones of the rail sides, and (4) pairs of cooperating mechanical stops arranged on the tamping picks so that a respective stop of each pair on the remote tamping pick engages the cooperating stop of each pair on the other tamping pick for limiting the pivotal movement of the remote tamping pick in the first and second end positions, respectively, and (b) independently operable drives connected to the ballast tamping units for displacing the ballast tamping units in a direction extending transversely to the machine frame elongation.

2. The ballast tamping assembly of claim 1, wherein a longitudinal axis of the other tamping pick is inclined towards the carrier frame, with a lower end thereof being closer to the carrier frame than an upper end thereof, and a longitudinal axis of the pivotal tamping pick extends substantially parallel to the other tamping pick in the first end position thereof.

3. The ballast tamping assembly of claim 2, wherein the angle between the longitudinal axis of the other tamping pick and a vertical plane is between about 5° and 10°.

4. The ballast tamping assembly of claim 3, wherein the angle is 7°.

5. The ballast tamping assembly of claim 2, wherein the angle between the longitudinal axis of the pivotal tamping pick and a vertical plane is between about 5° and 10° in the second end position.

6. The ballast tamping assembly of claim 5, wherein the angle is 7°.

7. The ballast tamping assembly of claim 1, further comprising a bearing for the pivoting axis of the remote tamping pick, the stops delimiting pivoting of the remote tamping pick being arranged adjacent the bearing.

8. The ballast tamping assembly of claim 7, wherein the pivoting drive for the pivotal tamping pick is linked to the pivotal tamping pick at a side thereof opposite the stops in a direction extending transversely to the machine frame elongation.

* * * * *